US007025287B2

(12) United States Patent
Perkins

(10) Patent No.: US 7,025,287 B2
(45) Date of Patent: Apr. 11, 2006

(54) SHAFT SEAL WITH GREASE RETAINER

(75) Inventor: Lee A. Perkins, Lowden, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 158 days.

(21) Appl. No.: 10/640,613

(22) Filed: Aug. 14, 2003

(65) Prior Publication Data

US 2005/0035211 A1 Feb. 17, 2005

(51) Int. Cl.
*B05B 3/04* (2006.01)

(52) U.S. Cl. ..... 239/222.17; 239/201; 239/223; 239/224; 239/259

(58) Field of Classification Search ..... 239/201, 239/222.11, 222.17, 223, 224, 251, 259, DIG. 4
See application file for complete search history.

(56) References Cited

U.S. PATENT DOCUMENTS 4,796,811 A 1/1989 Davisson
5,058,806 A 10/1991 Rupar
RE33,823 E * 2/1992 Nelson et al. ..... 239/222.17
5,288,022 A 2/1994 Sesser
5,588,595 A * 12/1996 Sweet et al. ..... 239/222.17
6,244,521 B1 6/2001 Sesser
6,494,384 B1 12/2002 Meyer
6,499,672 B1 12/2002 Sesser
6,651,905 B1 11/2003 Sesser et al.

* cited by examiner

*Primary Examiner*—Steven J. Ganey
(74) *Attorney, Agent, or Firm*—Nixon & Vanderhye P.C.

(57) ABSTRACT

A seal arrangement for a rotatable shaft that is secured at one end thereof in a housing, and that mounts a water distribution plate on an opposite end thereof, the shaft seal comprising a flexible annular member having a radially inner portion including at least one tapered lip extending in one direction along the shaft and adapted to engage the shaft, and a radially outer portion seated on a support in the housing; and at least one retainer overlying the seal and holding the seal in position on the support, the at least one retainer having a radially inner portion that substantially encloses the at least one tapered lip.

6 Claims, 5 Drawing Sheets

SHAFT SEAL WITH GREASE RETAINER

This invention relates generally to sprinkler devices and, more particularly, to an improved shaft seal for a rotatable sprinkler plate.

BACKGROUND OF THE INVENTION

Moving irrigation systems, such as conventional pivot move and lateral move systems, are known to incorporate conduit truss span assemblies and a plurality of drop tubes by which a corresponding number of sprayheads incorporating rotatable water distribution plates (also referred to as rotor plates or spinners), fixed spray plates, or bubbler devices are suspended so as to be located in close proximity to crops or other plants.

In this regard, there are currently in use modular sprayheads, also manufactured by the assignee of this invention, that include sprinkler bodies and rotary stream distributors (or rotor plates) supported in cap assemblies that are designed for quick assembly and disassembly from the respective sprinkler bodies. The cap is typically secured to the sprinkler body by a conventional screw thread arrangement in combination with a locking mechanism where a plurality of vertically extending projections on the cap engage a corresponding plurality of notches formed on the cap mounting ring when the cap reaches the full extent of its rotational movement relative to the body during threading.

Rotor plates or spinners typically are fixed to a shaft that is, in turn, mounted within a housing in the sprinkler cap assembly. A rubber (or other suitable material) shaft seal is received over the shaft and held by means of a retainer on a support secured within a shaft housing on the cap. The retainer, however, leaves the sealing edge or lip of the shaft seal exposed. This arrangement can lead to damage to the seal through exposure to the elements, and may also hinder rotation of the shaft if debris migrates past the exposed lip of the seal.

BRIEF DESCRIPTION OF THE INVENTION

This invention provides an improved shaft seal arrangement through a modification to the retainer component. Specifically, in one exemplary embodiment, the retainer is extended axially and radially in its center or hub area to substantially enclose the sealing edge or lip of the shaft seal. Only a slight radial gap or tolerance remains between the retainer and the shaft. Grease added between the shaft seal and retainer not only lubricates the lip of the seal but also prevents debris from passing through the radial gap between the retainer and the shaft.

In a second exemplary embodiment, where a double lip seal is used, a second retainer, constructed as described above, may be located over a first un-modified retainer, with grease packed between the two retainers.

It will be appreciated that the invention is applicable to any rotor plate or spinner shaft seal arrangement including those supported by plain bearings, ball bearings or other bearing arrangements, and is also applicable to other shaft mounting arrangements in fixed or removable cap assemblies, or, for example, where the shaft is mounted in the sprinkler body itself.

Accordingly, in one embodiment, the invention relates to a seal arrangement for a rotatable shaft that is secured at one end thereof in a housing, and that mounts a water distribution plate on an opposite end thereof, the shaft seal comprising a flexible annular member having a radially inner portion including at least one tapered lip extending in one direction along the shaft and adapted to engage the shaft, and a radially outer portion seated on a support in the housing; and at least one retainer overlying the seal and holding the seal in position on the support, the at least one retainer having a radially inner portion that substantially encloses the at least one tapered lip.

In another aspect, the invention relates to a sprinkler comprising a sprinkler body supporting a nozzle and a cap assembly axially spaced from the nozzle, the cap assembly supporting a rotatable water distribution plate in alignment with the nozzle for distributing water emitted from the nozzle and impinging on the plate; and a shaft seal comprising a flexible annular member having a radially inner portion including at least one tapered lip extending in one direction along the shaft and adapted to engage the shaft and a radially outer portion seated on a support in the housing; and a retainer overlying the seal and holding the seal in position on the support, the retainer having a radially inner portion that substantially encloses the at least one tapered lip.

In still another aspect, the present invention relates to a sprinkler comprising a sprinkler body supporting a nozzle and a cap assembly axially spaced from the nozzle, the cap assembly supporting a rotatable water distribution plate in alignment with the nozzle for distributing water emitted from the nozzle and impinging on the plate; a shaft seal comprising a pair of lip seals extending in opposite directions from a radially outer portion of the shaft seal, the radially outer portion of the shaft seal seated on a support fixed within the housing; a first retainer overlying the radially outer portion of the shaft seal and a second retainer overlying the first retainer and including a radially inner portion substantially enclosing one of the lip seals, and wherein space between the first and second retainers is filled with lubricant to thereby lubricate the one of the lip seals.

DETAILED DESCRIPTION OF THE INVENTION

Figure 1:
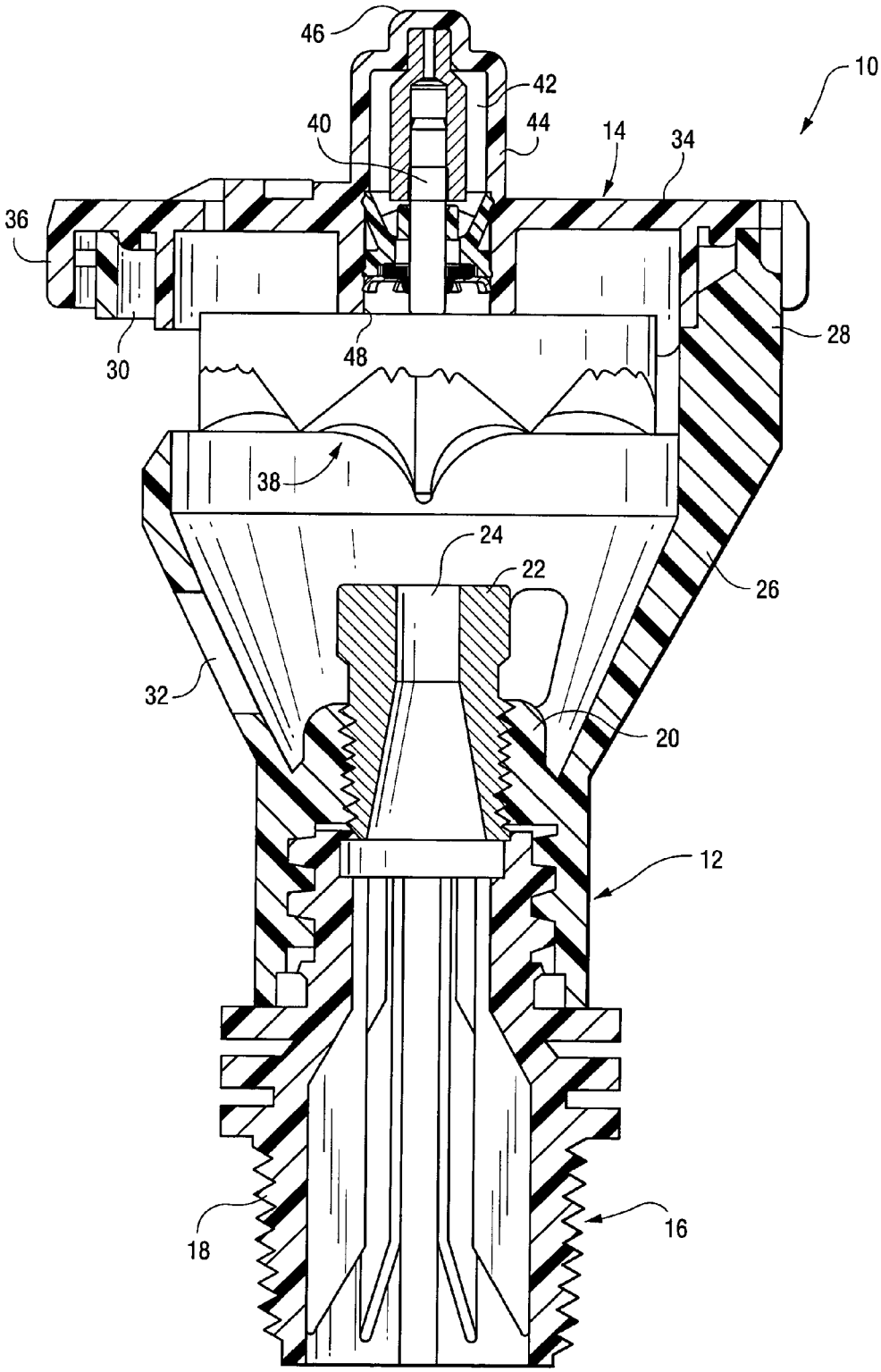
Fig. 1 (PRIOR ART)
FIG. 1 is a side elevation, partly in section, of a conventional sprinkler body and cap assembly.
Figure 2:
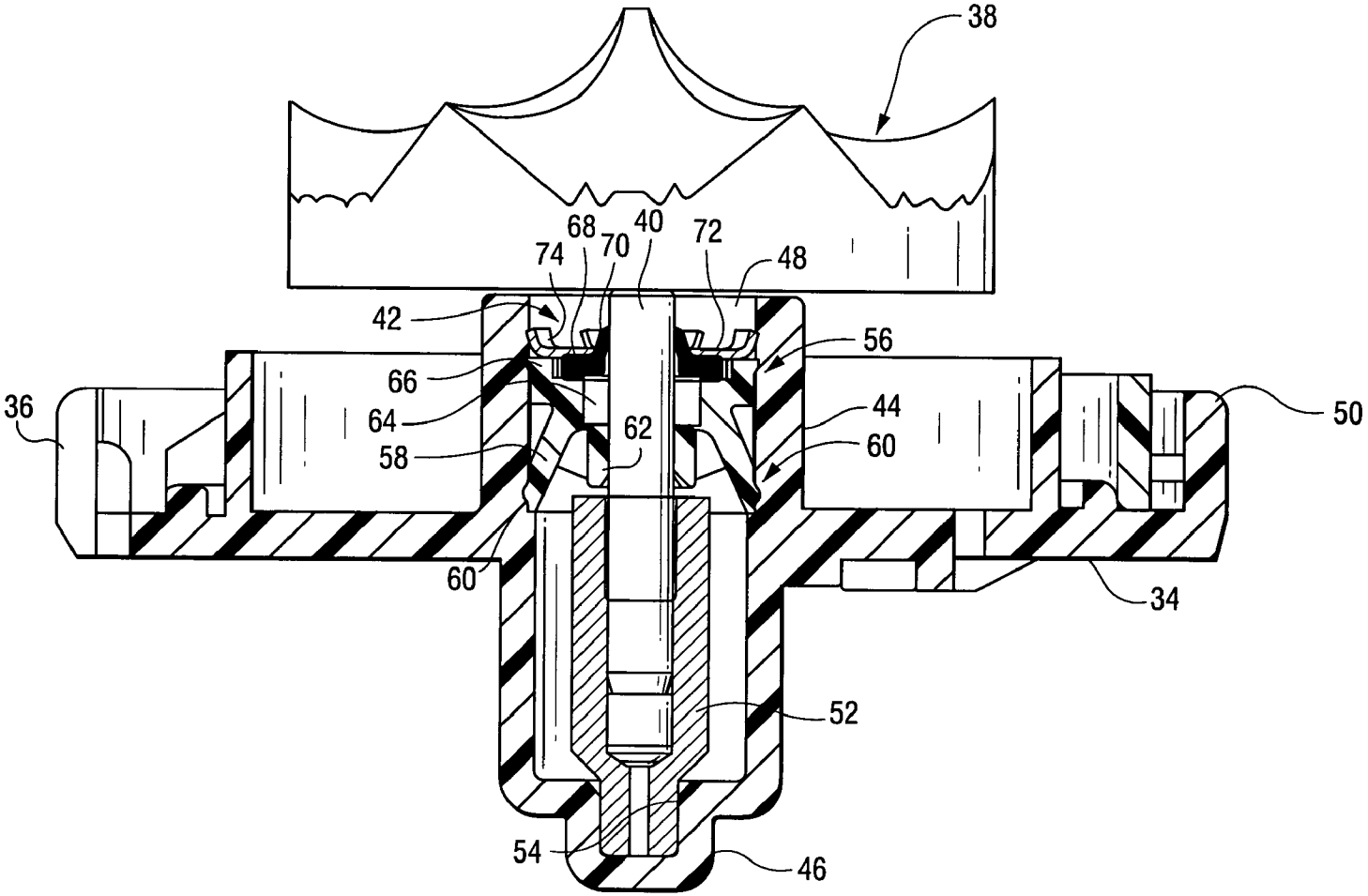
Fig. 2 (PRIOR ART)
FIG. 2 is a side elevation, partly in section, of an enlarged cap assembly taken from FIG. 1, but inverted relative to the orientation in FIG. 1.

Referring to FIGS. 1 and 2, a known modular sprinkler assembly 10 includes a sprinkler body 12 and a cap 14 removably attached thereto. The sprinkler body 12 threadably receives at its lower end an inlet bushing 16 which is also provided with exterior threads 18 for attachment to a water inlet hose, pipe or the like. The sprinkler body 12 is provided with an interiorly threaded outlet portion 20 which receives an exteriorly threaded nozzle 22 having a discharge orifice 24. It will be appreciated that nozzle 22 may be removable and interchangeable with other nozzles of different orifice size.

The body 12 is further provided with an upwardly and outwardly extending frusto-conical portion 26 which, in turn, supports a plurality of, e.g., three upstanding posts 28 (only one visible) which support an annular cap mounting ring 30. Posts 28 are equally spaced about the frusto-conical portion 26. The frusto-conical portion 26 may also be provided with a plurality of ports 32 which provide physical and visual access to the nozzle 22. The annular ring 30 may be provided with any suitable means (not shown) cooperable with complimentary means in the cap 14 for attaching the caps to the sprinkler body for easy removal and/or replacement. See, for example, U.S. Pat. No. 5,224,653 for one suitable arrangement.

The cap 14 (also preferably plastic) is a generally circular disk-like structure, including a top wall or surface 34 and an outer, annular depending skirt 36. The cap supports a water distribution plate or spinner 38 by means of a shaft 40 (FIG. 2) received in a centrally located cavity 42 in the cap, as defined primarily by an integral cylindrical wall or housing 44, closed at one end 46 and open at an opposite end 48. The housing 44 projects from both sides of the cap top surface 34 and may be integrally formed with the cap. The cavity 42 within housing 44 supports the shaft 40 by means of an elongated rotatable sleeve bearing 52 seated in a smaller recess 54 at the closed end 46 of the housing. The shaft 40 projects axially beyond the open end of the housing wall and is adapted to mount the spinner 38 for rotation with the shaft 40.

Axially adjacent the sleeve bearing 52 is a rigid retainer and seal support component 56 that includes a tapered flexible skirt portion 58 that engages the inner surface or wall of the housing 44, and a cooperating groove and tab arrangement (generally indicated at 60) may be used to hold the support 56 in place. A center hub 62 of the support serves as a stationary plain bearing for the shaft 40 and establishes a grease reservoir 64 surrounding the shaft, between the bearing 62 and the seal 68. An upper ring portion 66 of the support also engages the inner surface of the housing 44, and may also employ a groove and tab arrangement similar to 60 for holding the support in place within the housing cavity. The rubber (or similar) seal 68 is located within a recess centered within the ring 64, with an outer radial portion of the seal 68 seated in the recess. An inner, tapered lip portion (or lip) 70 provides a sealing edge that engages the shaft 40. A disk-like retainer 72 is located over the seal 68 so as to hold the seal in place, the retainer press fit into the upper open end of cylindrical wall 44, with resilient upturned spokes 74 engaged with the wall. Typically, grease is added behind the seal 68, i.e., in the grease reservoir 64, to lubricate the underside of the lip 70 and the plain bearing 62. Note, however, that the sealing edge or lip 70 remains exposed to the elements. This arrangement can lead to premature wearing and deterioration of the lip 70 and subsequent migration of debris past the seal.

Figure 3:
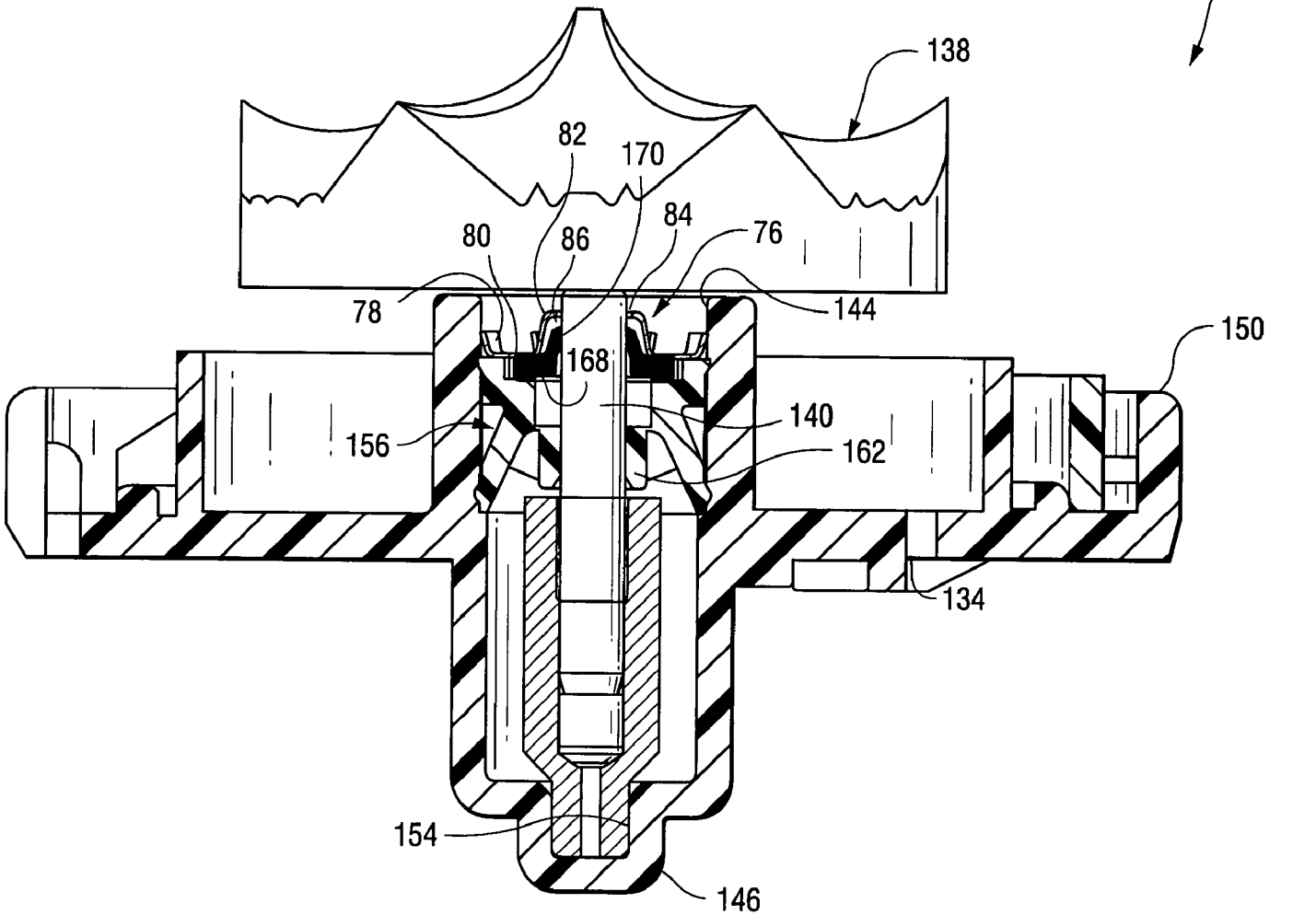
FIG. 3 is a side elevation, partly in section, of a cap assembly in accordance with a first exemplary embodiment of the invention.

Turning to FIG. 3, the cap 114, spinner 138, shaft 140, seal 168, etc. are identical to the corresponding components in FIGS. 1 and 2 and, accordingly, similar reference numerals, but with the prefix "1" added, are used to indicate such components. The single differentiated component is the modified retainer 76. Significantly, the retainer 76 now not only includes outer tapered flanges or spokes 78 that engage the inner surface of the cylindrical wall 144 of the housing cavity and a center hub portion 80, but also a radially inner, tapered portion 82 that extends axially and radially, terminating at a center opening 84, thus, substantially enclosing the lip 170 of the seal 168. Sufficient clearance is provided between the radially inner edge of the inner tapered portion 82 and the shaft 140 so that the shaft can freely rotate relative to the cap 114. Grease or other suitable lubricant may now be added to the annular space 86 above the lip 170. The grease also fills the radial gap at the opening 84, resulting in an effective barrier to any dirt or debris that could otherwise contact and damage the seal 168. Moreover, not only is the lip 170 no longer exposed to the elements, but both sides of the lip are now maintained in a lubricated condition by the added grease in space 86, thereby increasing the life of the seal.

Figure 4:
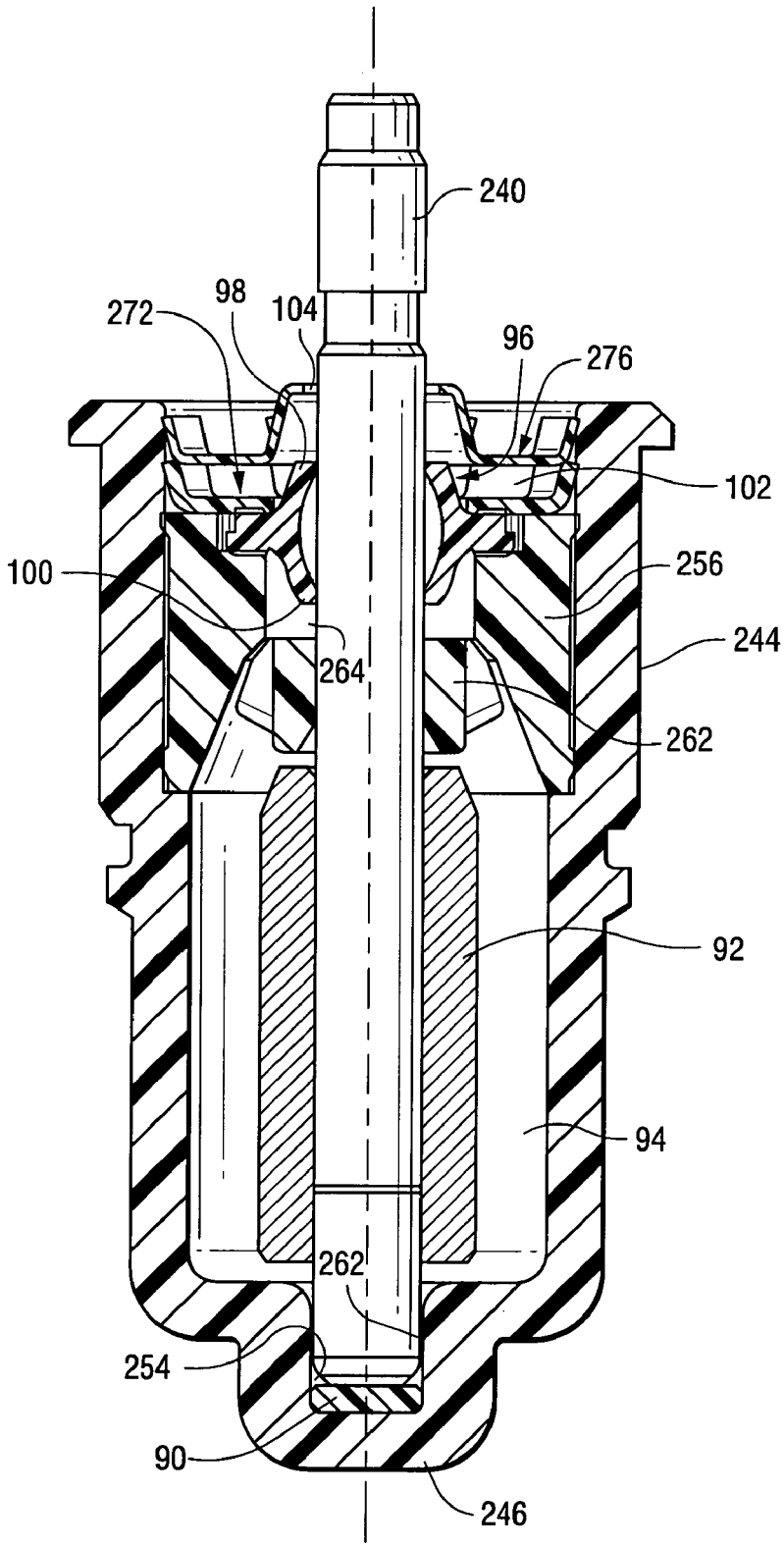
FIG. 4 is a side elevation, partly in section, of a cap shaft housing in accordance with a second exemplary embodiment of the invention.

A second embodiment of this invention is shown in FIG. 4. Here, only the housing portion of the cap assembly is shown, and it will be appreciated that the remainder of the cap assembly may be similar to that shown in FIGS. 1 and 2, but may also form a part of any other cap or sprinkler component on which the shaft can be supported for rotation. For convenience, elements similar to those in FIGS. 1 or 3 are indicated by similar reference numerals but with the prefix "2" added. In this embodiment, the shaft 240 is supported in the housing 244 in a configuration where rotation of the shaft 240 is retarded by viscous fluid in the housing 244. Specifically, the shaft 240 is seated in a recess 254 in the closed end 246 of the housing 244 and engages a thrust bearing 90 interposed between the end of the shaft and the bottom wall of the recess. A rotor 92 is secured about the shaft, and the cavity 94 surrounding the shaft and rotor is filled with a viscous silicon fluid so that the shaft 240 spins at a controlled reduced speed, rather than in a free spinning manner. The degree of speed retardation may be controlled by the amount and composition of the viscous fluid, and by the shape of the rotor.

A seal support 256 is seated within the housing for supporting the shaft seal. The support 256 also incorporates a plain bearing 262 and supports the shaft seal as in the previously described embodiments, but the periphery of the support has been slightly modified to fit the housing in this particular application. The seal 96 in this embodiment is of a double lip design where the outer periphery of the seal 96 is seated on the support 256 in the same manner as described above, but lip portions 98, 100 extend in opposite directions to engage the shaft 240 in two axially spaced positions. The reservoir 264 between the lower lip 100 and the plain bearing 262 may be filled with grease or other suitable lubricant. A first retainer 272 that holds the seal 96 on the support 256 may be a conventional retainer, similar to retainer 72 shown in FIGS. 1 and 2. Here, however, a second retainer 276 similar to that shown in FIG. 3 is applied over the first retainer 272, creating an additional reservoir 102 between the two retainers. This reservoir is also filled with grease so that both lip portions 98, 100 of the seal are well lubricated. Here again, the grease in an upper portion of the reservoir 102 will effectively seal the radial gap between the radially inner edge 104 of the retainer 276 and the shaft 240.

Figure 5:
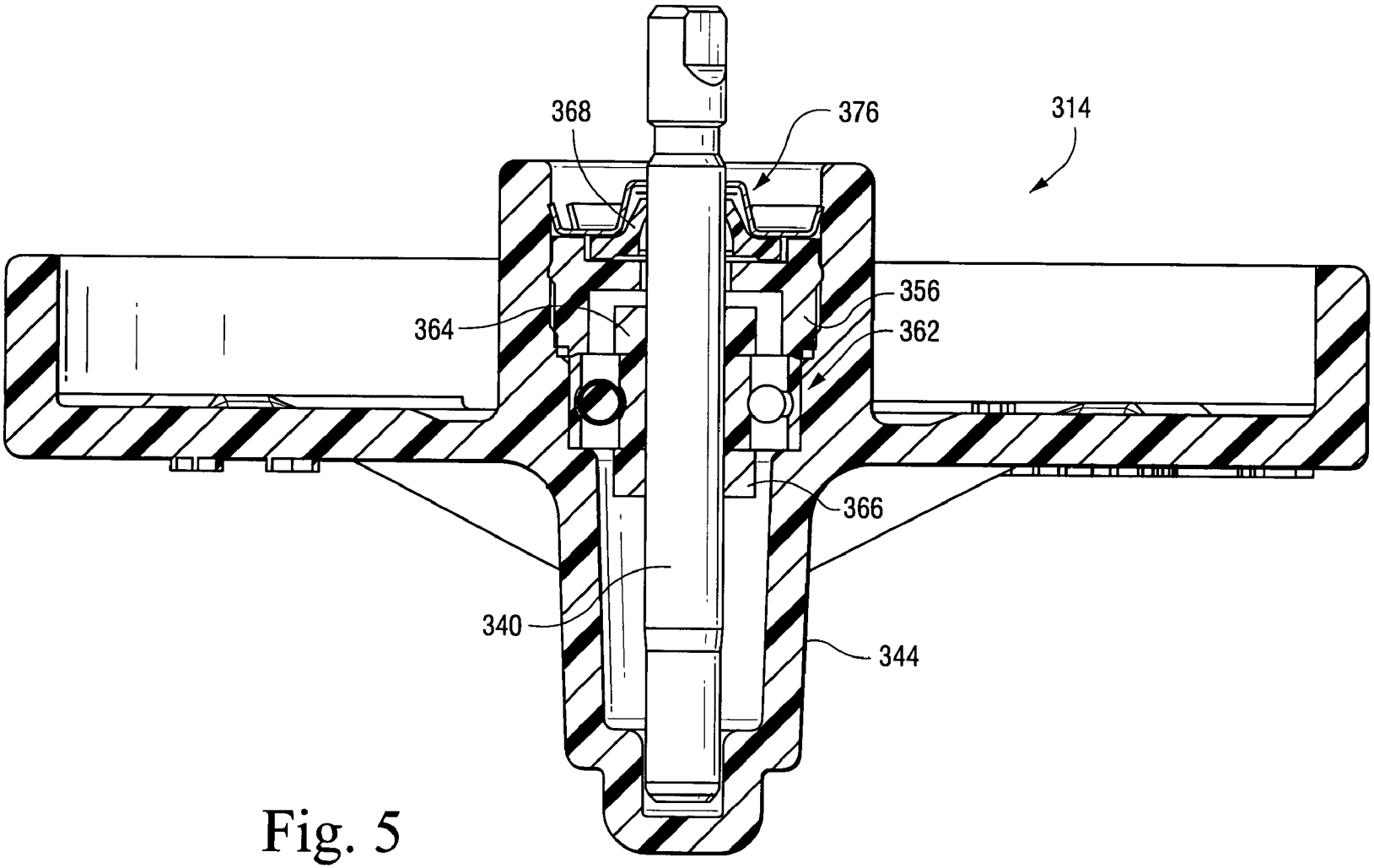
FIG. 5 is a side elevation, partly in section, of an embodiment similar to that in FIG. 3 but where the shaft is supported by a ball bearing.

Still another arrangement is shown in FIG. 5 where a cap 314 is adapted to mount a spinner (not shown) similar to spinner 138 in FIG. 3, on a shaft 340 secured in housing 344. In this embodiment, the housing 344 and shaft seal support 356 have been modified to eliminate the plain bearing 162 in favor of a ball bearing 362 that is held in place by a pair of bearing retainers 364, 366 on either side of the bearing. The shaft seal arrangement is otherwise similar to that shown in FIG. 3, with the retainer 376 applied over the single lip seal 368 to substantially enclose the sealing edge or lip of the seal as described hereinabove.

It will be appreciated that the invention is fully applicable to any of a number of rotary plate shaft configurations mounted in sprinkler caps or other sprinkler components and where the rotor plates are free spinning or controlled by viscous retarders, and where the shafts are supported by plain or ball bearings.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A seal arrangement for a rotatable shaft that is secured at one end thereof in a housing, and that mounts a water distribution plate on an opposite end thereof, the shaft seal comprising a flexible annular member having a radially inner portion including at least one tapered lip extending in one direction along said shaft and adapted to engage the shaft, and a radially outer portion seated on a support in said housing; and at least one retainer overlying the seal and holding the seal in position on said support, said at least one retainer having a radially inner portion that substantially encloses said at least one tapered lip, and wherein a space between the tapered lip of the seal and the radially inner portion of the retainer is substantially filled with grease.

2. The seal arrangement of claim 1 wherein said shaft is supported in said housing by a ball bearing.

3. The seal arrangement of claim 1 wherein said seal is composed of rubber.

4. A sprinkler comprising a sprinkler body supporting a nozzle and a cap assembly axially spaced from said nozzle, said cap assembly supporting a rotatable water distribution plate in alignment with said nozzle for distributing water emitted from said nozzle and impinging on said plate; and a shaft seal comprising a flexible annular member having a radially inner portion including at least one tapered lip extending in one direction along said shaft and adapted to engage the shaft and a radially outer portion seated on a support in said housing; and a retainer overlying the seal and holding the seal in position on said support, the retainer having a radially inner portion that substantially encloses said at least one tapered lip; and wherein a space between the tapered lip of the seal and the radially inner portion of the retainer is substantially filled with lubricant.

5. The seal arrangement of claim 4 wherein said shaft is supported in said housing by a ball bearing.

6. The seal arrangement of claim 4 wherein said seal is composed of rubber.

* * * * *